US007178841B1

(12) United States Patent
Moreno

(10) Patent No.: US 7,178,841 B1
(45) Date of Patent: Feb. 20, 2007

(54) LOCKING TETHER ASSEMBLY FOR SHIPPING CONTAINER DOORS

(76) Inventor: Jose M. Moreno, 2270 NW. 87 Ter., Pembroke Pines, FL (US) 33024

( * ) Notice: Subject to any disclaimer, the term of this patent is extended or adjusted under 35 U.S.C. 154(b) by 0 days.

(21) Appl. No.: 11/253,737

(22) Filed: Oct. 20, 2005

(51) Int. Cl.
*E05B 39/02* (2006.01)
*B65D 27/30* (2006.01)

(52) U.S. Cl. ..... 292/327; 292/307 R; 292/328; 292/329; 292/307 A; 70/50; 24/136 L

(58) Field of Classification Search ..... 292/327, 292/315–317, 328, 329, 288, 331, 320, 321, 292/326, 307 A, 307 B, 307 R; 70/23, 34, 70/50; 24/136 L, 136 R, 464
See application file for complete search history.

(56) References Cited

U.S. PATENT DOCUMENTS

| | | | | | |
|---|---|---|---|---|---|
| 304,258 | A * | 8/1884 | Brooks | 292/320 |
| 720,806 | A * | 2/1903 | Kerniea et al. | 292/326 |
| 1,793,790 | A * | 2/1931 | Fowler | 211/119.1 |
| 2,784,020 | A * | 3/1957 | McCord | 292/327 |
| 2,820,660 | A * | 1/1958 | Ainsworth | 292/327 |
| 3,540,637 | A * | 11/1970 | Robins et al. | 224/103 |
| 4,312,529 | A * | 1/1982 | Gillette | 292/315 |
| 4,628,630 | A * | 12/1986 | Bohme | 43/43.12 |
| 4,982,985 | A * | 1/1991 | Atlas | 292/327 |
| 5,020,192 | A * | 6/1991 | Gerlach | 24/136 R |
| 5,114,196 | A | 5/1992 | Storer | 292/307 R |
| 5,127,687 | A * | 7/1992 | Guiler | 292/327 |
| 5,762,386 | A * | 6/1998 | Fuehrer | 292/307 R |
| 5,984,380 | A | 11/1999 | Rice | 292/1 |
| 6,000,736 | A * | 12/1999 | Leon et al. | 292/326 |
| 6,007,121 | A * | 12/1999 | Dreisbach et al. | 292/307 R |
| 6,764,114 | B1 * | 7/2004 | Guillon | 292/307 R |
| 6,839,942 | B1 * | 1/2005 | Spearing | 24/115 R |
| 6,962,376 | B2 * | 11/2005 | Palzkill et al. | 292/327 |
| 2002/0069681 | A1 * | 6/2002 | Golden et al. | 70/34 |
| 2005/0006910 | A1 | 1/2005 | Foigel et al. | 292/315 |

* cited by examiner

*Primary Examiner*—Brian E. Glessner
*Assistant Examiner*—Carlos Lugo
(74) *Attorney, Agent, or Firm*—Albert Bordas

(57) ABSTRACT

A single-use security locking assembly for shipping containers, comprising, a pin, a tether assembly, a locking member, and locking means characterized in that the tether assembly snugly fits around door bars of a shipping container.

3 Claims, 3 Drawing Sheets

LOCKING TETHER ASSEMBLY FOR SHIPPING CONTAINER DOORS

BACKGROUND OF THE INVENTION

1. Field of the Invention

The present invention relates to security systems and more particularly, to security locking assemblies for shipping containers.

2. Description of the Related Art

Millions of shipping containers flow through ports all over the world on a daily basis. It is imperative to keep the contents of those shipping containers secure and not have them compromised. In addition to theft of contents, there is a need to ensure that shipping containers are not used as vehicles to transport illegal narcotics, illegal weapons, and otherwise unauthorized matter. Theft is often accomplished when a container door itself is compromised, such as when a handle is disassembled when its rivets are removed to open container doors. Once disassembled, the handle is typically re-riveted to not raise suspicion. In other cases, the locking systems themselves are compromised.

Applicant believes that the closest reference corresponds to U.S. published patent application no. 20050006910, published for Foigel, Veniamin A.; et al. on Jan. 13, 2005 for Cable lock and method. However, it differs from the present invention because Foigel, Veniamin A.; et al. teaches some embodiments of a cable lock provide a body defining a housing in which a cable can be received to lock the cable lock. In some embodiments, the cable is rotatable with respect to the housing when the cable lock is in a locked state, thereby increasing the difficulty of circumventing the lock. The cable lock can have a wall with an aperture shaped to compliment the cross-sectional shape of the cable passed therethrough, an end wall that can be attached to the housing by rolling or crimping an edge of the housing over the end wall, and/or one or more visual indicators providing a manner by which tampering of the cable lock can be detected.

Applicant believes that another reference corresponds to U.S. Pat. No. 5,984,380 issued to Rice on Nov. 16, 1999 for Tether assembly. However, it differs from the present invention because Rice teaches a tether assembly for tethering an object, which tether assembly includes a cable having opposite ends and a connector attached to one of the opposite ends, and a retaining block for securing the cable to a support. The retaining block includes two parallel through-bores, which extend through the retaining block and are provided for receiving the cable. The retaining block also includes a stepped bore, which has a threaded portion and a non-threaded terminal portion. The non-threaded terminal portion of the stepped bore has a cylindrical portion, which terminates at a common intersection with each of the two parallel through-bores, and a tapered end. A spherical element is positionable in the non-threaded portion of the stepped bore. In use, the retaining block is secured to a support structure and the connector is connected to an object to be tethered. Next, the cable is looped through the two parallel through-bores and a threaded member is driven into the threaded portion of the stepped bore to press the spherical element against the cable. The tether assembly can be used to tether door security devices, outboard motors, trailers, and a variety of other objects.

Applicant believes that another reference corresponds to U.S. Pat. No. 5,114,196 issued to Storer on May 19, 1992 for Tamper deterrent locking device and method of using. However, it differs from the present invention because Storer teaches a tamper deterrent locking device including a cable secured to a female member, the cable forming a loop projecting from the female member with the free end thereof projecting through an aperture in the female member. The male member fits into the aperture to frictionally lock the cable between the male and female members. The loop is passed through two aligned holes in two pieces of relatively movable apparatus whereby one who moves said relatively movable pieces is required to sever the cable or disengage it from the frictional engagement.

Other patents describing the closest subject matter provide for a number of more or less complicated features that fail to solve the problem in an efficient and economical way. None of these patents suggest the novel features of the present invention.

SUMMARY OF THE INVENTION

A single-use security locking assembly for shipping containers, comprising a pin comprising a head having a shank extending therefrom. The shank has at least two holes. Extending from the first hole to the second hole are first and second channels. The shank further comprises a groove and terminates at an end. The groove is perpendicularly disposed to the first and second channels. A tether assembly has a tether that comprises first and second ends. The first end has end and the second end has an eyebolt. The eyebolt has a shank and a face. The face has a hole. The hole on the face has cooperative dimensions to receive the end of the tether. A locking member comprises sidewalls and an axial through aperture, and it terminates at end. The locking member also has a snap ring. The snap ring has cooperative dimensions to snap onto the groove. The aperture has cooperative dimensions to receive the end of the pin. The locking member has means to lock the tether assembly to the pin by inserting the end of the tether through the hole of the face and through the first hole, along the first channel, through the second hole. The end of the pin is aligned and inserted into the aperture, and the tether falls into the second channel as the locking member slidably journals with sufficient force onto the shank until the snap ring snaps into the groove. The tether assembly snugly fits around door bars of a container, such as a shipping container.

It is therefore one of the main objects of the present invention to provide a locking tether assembly for shipping container doors that is effective against tampering.

It is another object of this invention to provide a locking tether assembly for shipping container doors that is durable.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
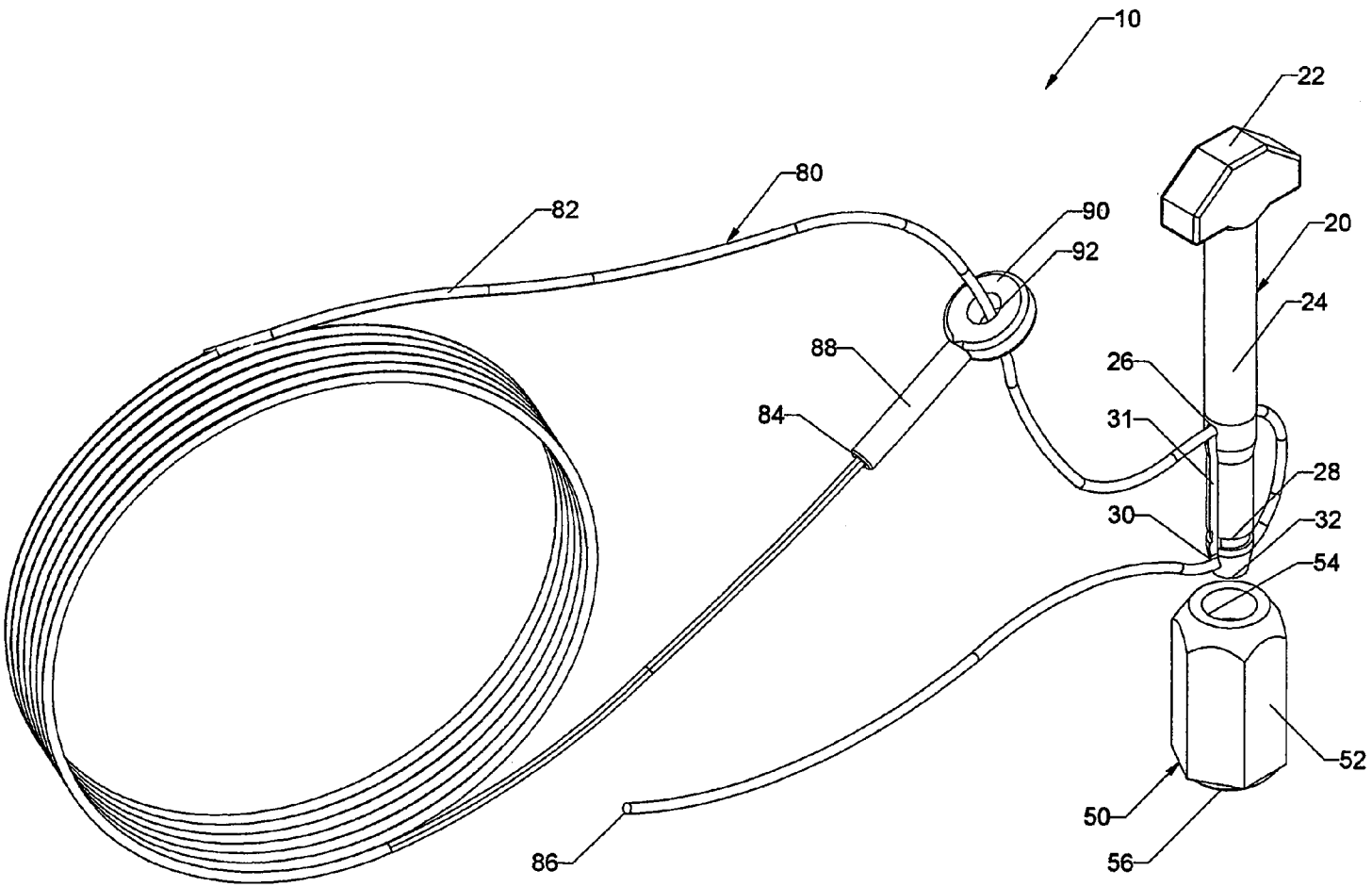
FIG. 1 represents a perspective view of the instant invention unlocked.

Referring now to the drawings, where the present invention is generally referred to with numeral 10, it can be observed that it basically includes pin 20, locking member 50, and tether assembly 80.

As seen in FIG. 1, pin 20 comprises head 22 having shank 24 extending therefrom. Shank 24 has holes 26 and 30. Extending from hole 26 to hole 30 are channels 31, only one of which is illustrated in this view. Shank 24 further comprises groove 28 and terminates at end 32. Locking member 50 comprises sidewall 52 and aperture 54, and terminates at end 56. Aperture 54 having cooperative dimensions to receive end 32 of pin 20. Tether assembly 80 comprises tether 82 extending from eye-bolt 84. Eye bolt 84 has shank 88. Eye-bolt 84 also comprises face 90 having hole 92. Hole 92 having cooperative dimensions to receive end 86 of tether 82.

As seen in FIG. 1, to position instant invention 10 for locking, end 86 is inserted through hole 92, through hole 26, along channel 31, located opposite the illustrated channel 31, and through hole 30.

Figure 3:
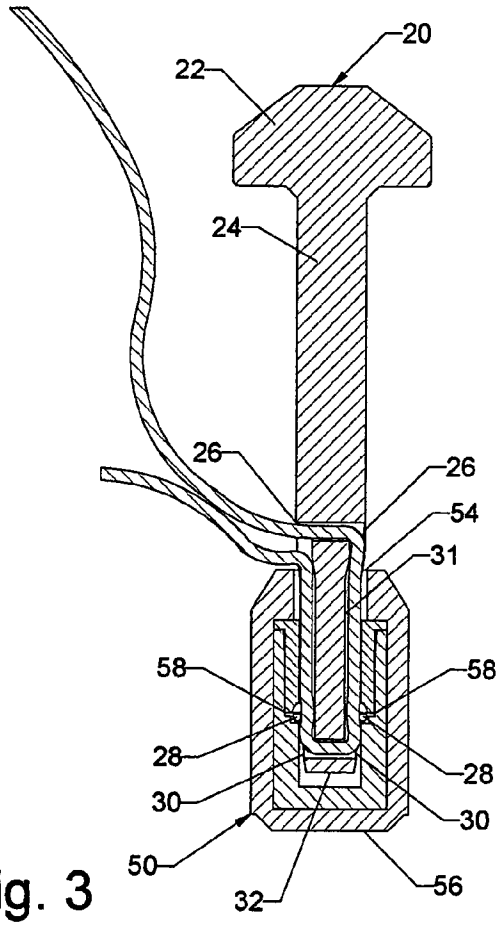
FIG. 3 shows a cut view of the locking member locked upon the pin.
Figure 2:
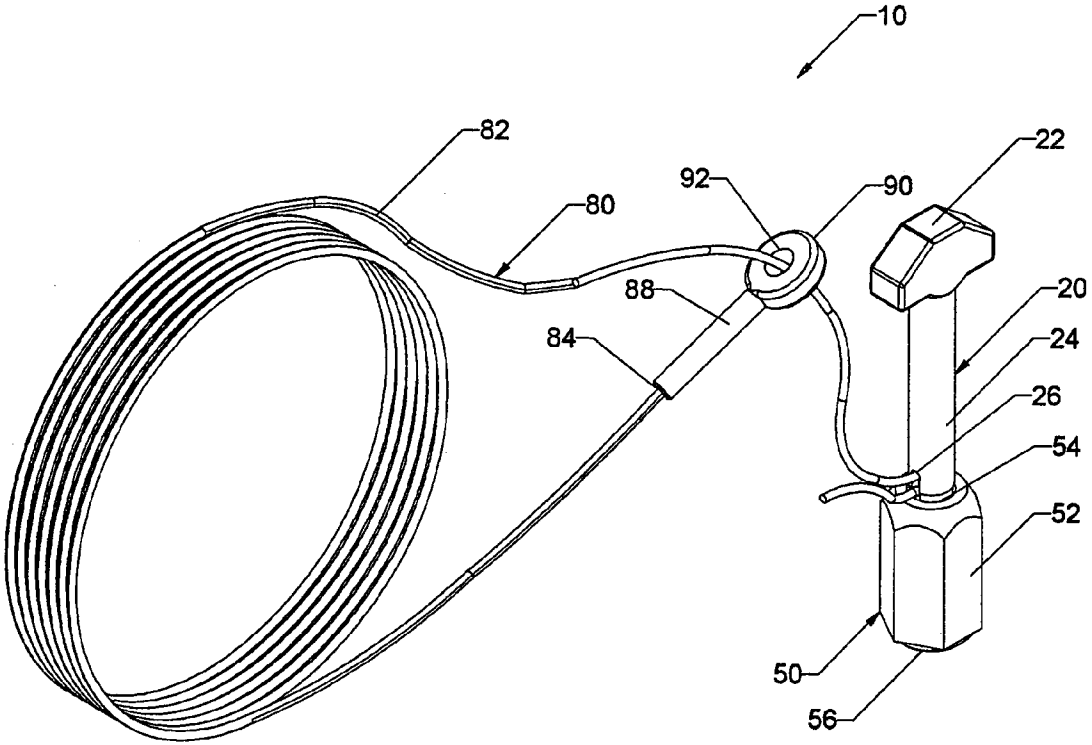
FIG. 2 represents a perspective view of the instant invention ready to be locked.

As seen in FIGS. 2 and 3, to lock instant invention 10, end 32 is aligned with and inserted into aperture 54. It is noted that tether 82 falls into channel 31, seen in FIG. 1, as locking member 50 slidably journals onto shank 24 until snap ring 58 snaps into groove 28.

Figure 4:
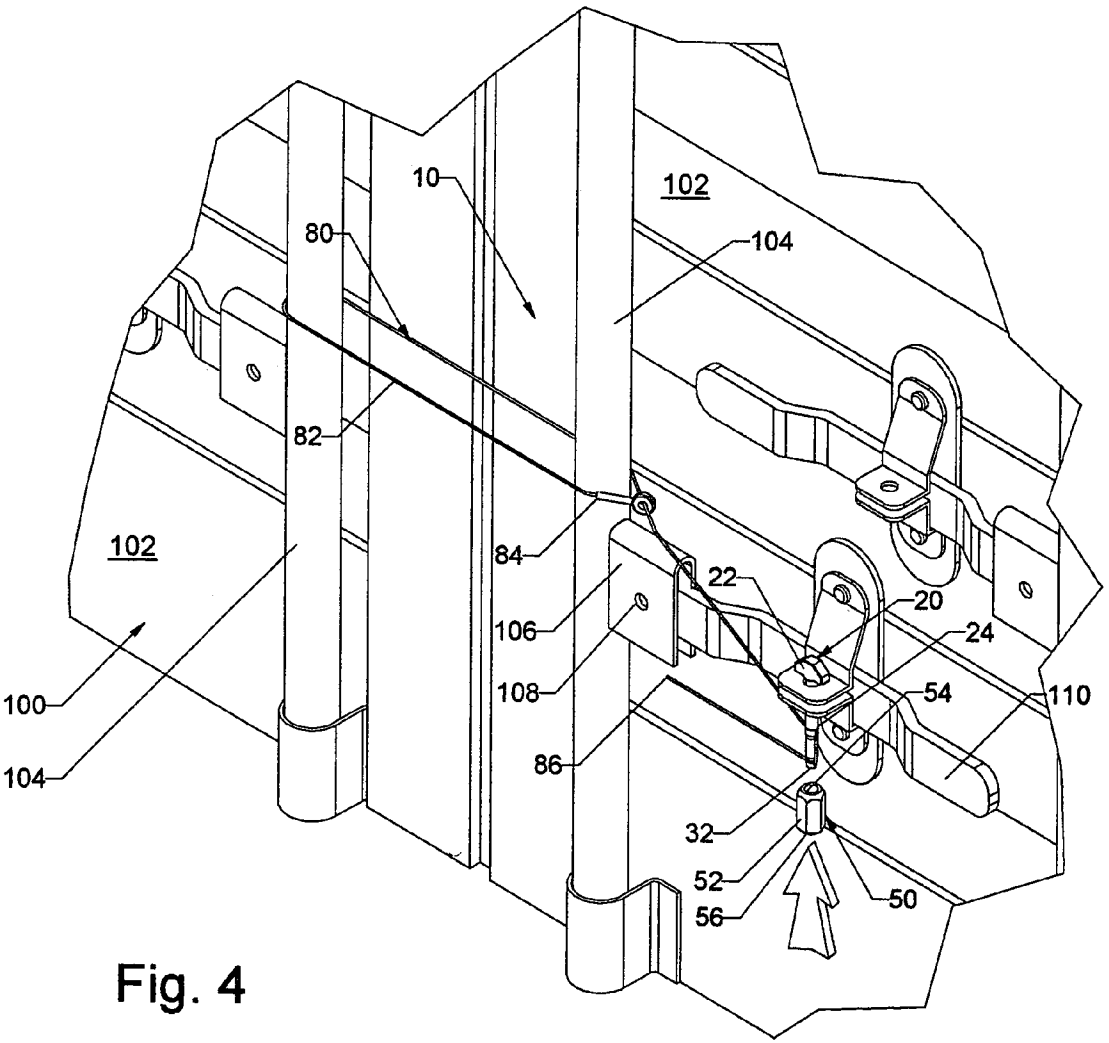
FIG. 4 shows a perspective view of the instant invention secured upon shipping container doors.

As seen in FIG. 4, door assembly 100 comprises doors 102 each having door bars 104. One of doors 102 has frame 106 comprising handle 110. Handle 110 is used to open doors 102. Typically, frame 106 is secured onto door 102 with rivet 108. To lock instant invention 10 upon door assembly 100, tether 82 is wrapped around each of the door bars 104. Then, as described above, end 86 is inserted through hole 92, through hole 26, along channel 31, located opposite the illustrated channel 31 in FIG. 1, and through hole 30. To lock instant invention 10, end 32 is aligned with and inserted into aperture 54, and tether 82 falls into channel 31 as locking member 50 slidably journals onto shank 24 until snap ring 58 snaps into groove 28.

Even if rivet 108 and handle 110 are removed from door assembly 100, doors 102 may not be opened once instant invention 10 is locked since tether assembly 80 wraps around door bars 104.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A single-use security locking assembly for shipping containers, comprising:

A) a pin (20) comprising head (22) having shank (24) extending therefrom, said shank (24) has holes (26) and (30), extending from said hole (26) to said hole (30) are first and second channels (31), said shank (24) further comprises a groove (28) and terminates at end (32), said groove (28) perpendicularly disposed to said first and second channels (31);

B) a tether assembly (80) having tether (82), said tether (82) comprising first and second ends, said first end having end (86), said second end having an eye bolt (84), said eye bolt (84) having a shank (88) and a face (90), said face (90) having hole (92), said hole (92) having cooperative dimensions to receive said end (86); and C) a locking member (50) comprising sidewalls (52) and axial through aperture (54), and terminating at end (56), said locking member (50) also having a snap ring (58), said snap ring (58) having cooperative dimensions to snap onto said groove (28), said aperture (54) having cooperative dimensions to receive said end (32) of said pin (20), said locking member (50) having means to lock said tether assembly (80) to said pin (20) comprising inserting said end (86) through said hole (92) and through said hole (26), along said first channel (31), through said hole (30), said end (32) is aligned with and inserted into said aperture (54), and said tether (82) falls into said second channel (31) as said locking member (50) slidably journals with sufficient force onto said shank (24) until said snap ring (58) snaps into said groove (28).

2. The single-use security locking assembly for shipping containers set forth in claim 1, further characterized in that tether assembly (80) snugly fits around door bars of a container.

3. The single-use security locking assembly for shipping containers set forth in claim 2, further characterized in that the container is a shipping container.

* * * * *